US009541354B2

(12) United States Patent
Cohen

(10) Patent No.: US 9,541,354 B2
(45) Date of Patent: Jan. 10, 2017

(54) METHODS DEVICES APPARATUS ASSEMBLIES AND SYSTEMS FOR GENERATING AND DIRECTING SOUND PRESSURE WAVES

(71) Applicant: David Cohen, Herzeliya (IL)

(72) Inventor: David Cohen, Herzeliya (IL)

(73) Assignee: PSYCHOSONIC SYSTEMS LTD., Tel Aviv (IL)

( * ) Notice: Subject to any disclaimer, the term of this patent is extended or adjusted under 35 U.S.C. 154(b) by 0 days.

(21) Appl. No.: 14/401,866

(22) PCT Filed: May 21, 2013

(86) PCT No.: PCT/IB2013/054185
§ 371 (c)(1),
(2) Date: Nov. 18, 2014

(87) PCT Pub. No.: WO2013/175404
PCT Pub. Date: Nov. 28, 2013

(65) Prior Publication Data

US 2015/0144419 A1 May 28, 2015

(30) Foreign Application Priority Data

May 22, 2012 (IL) ..... 219931

(51) Int. Cl.
*F41H 13/00* (2006.01)
*G10K 15/04* (2006.01)
(Continued)

(52) U.S. Cl.
CPC ..... *F41H 13/0081* (2013.01); *F01N 1/065* (2013.01); *F41G 3/22* (2013.01); *G10K 15/04* (2013.01)

(58) Field of Classification Search
CPC ..... F41H 13/0081; G10K 15/04
(Continued)

(56) References Cited

U.S. PATENT DOCUMENTS 4,349,898 A * 9/1982 Drewes ..... F41B 15/00 367/138
5,864,517 A * 1/1999 Hinkey ..... F23C 15/00 116/137 A
(Continued)

FOREIGN PATENT DOCUMENTS

GB WO 2010103321 A1 * 9/2010 ..... F41H 11/02

OTHER PUBLICATIONS

International Search Report from a counterpart foreign application—PCT/IB2013/054185—mailed Apr. 17, 2014, two pages.
(Continued)

*Primary Examiner* — Jeremy Luks
(74) *Attorney, Agent, or Firm* — Vladimir Sherman; Professional Patent Solutions

(57) ABSTRACT

Disclosed are methods, devices, apparatus, assemblies and systems for generating and directing acoustic energy (e.g. sound). According to some embodiments, there may be provided a cyclical acoustic apparatus or generator comprising a cyclical combustions chamber adapted to cyclically generate acoustic energy. There may be provided an acoustic energy collection and guiding assembly adapted to channel sounds energy generated by said cyclical combustion chamber to an aiming and release apparatus, which aiming and release apparatus directs the acoustic energy towards a target zone.

14 Claims, 10 Drawing Sheets

(51) Int. Cl.
*F01N 1/06* (2006.01)
*F41G 3/22* (2006.01)

(58) Field of Classification Search
USPC ..... 181/142; 367/138
See application file for complete search history.

(56) References Cited

U.S. PATENT DOCUMENTS 5,973,999 A * 10/1999 Naff ..... G10K 15/04 181/142
6,052,336 A * 4/2000 Lowrey, III ..... G10K 15/02 367/134
6,359,835 B1 * 3/2002 Gayl ..... G10K 15/04 181/142
7,515,719 B2 * 4/2009 Hooley ..... F41H 13/0081 381/18
7,522,473 B2 * 4/2009 Zlotnik ..... G10K 15/04 367/139
2007/0079784 A1 * 4/2007 Sasaki ..... F02M 35/10019 123/184.53
2009/0057054 A1 3/2009 Kostun et al.
2009/0102203 A1 * 4/2009 Lu ..... F02C 5/12 290/40 R
2011/0000389 A1 1/2011 Fullerton
2011/0005420 A1 * 1/2011 Fullerton ..... F02K 7/02 102/202.7
2011/0080803 A1 4/2011 Vu et al.
2011/0235465 A1 * 9/2011 Bostick ..... F41H 13/0081 367/99
2011/0235467 A1 * 9/2011 Bostick ..... A01M 29/16 367/139

OTHER PUBLICATIONS

International Preliminary Report on Patentability and Written Opinion of the International Searching Authority from a counterpart foreign application—PCT/IB2013/054185—mailed Nov. 25, 2014, five pages.

* cited by examiner

METHODS DEVICES APPARATUS ASSEMBLIES AND SYSTEMS FOR GENERATING AND DIRECTING SOUND PRESSURE WAVES

FIELD OF INVENTION

The present invention relates generally to the field of sound wave generation and delivery. More specifically, the present invention relates to methods, devices, apparatus, assemblies and systems for generating and directing sound pressure waves.

BACKGROUND

Non-lethal weapons, also called less-lethal weapons, less-than-lethal weapons, non-deadly weapons, compliance weapons, or pain-inducing weapons are weapons intended to be less likely to kill a living target than are conventional weapons. It is often understood that accidental, incidental, and correlative casualties are risked wherever force is applied, but non-lethal weapons try to minimize the risk as much as possible. Non-lethal weapons are used in combat situations to limit the escalation of conflict or where employment of lethal force is prohibited or undesirable or where rules of engagement require minimum casualties or policy restricts the use of conventional force.

Non-lethal weapons may be used by conventional military in a range of missions across the force continuum. They may also be used by military police, by United Nations forces, and by occupation forces for peacekeeping and stability operations. Non-lethal weapons may also be used to channelize a battlefield or control the movement of civilian populations or limit civilian access to restricted areas (as they were utilized by the U.S.M.C.'s 1st Marine Expeditionary Force in Somalia in 1995). When used by police forces domestically, similar weapons, tactics, techniques and procedures are often called "less lethal" or "less than lethal" and are employed in riot control, prisoner control, crowd control, refugee control, and self-defense.

In the past, military and police faced with undesirable escalation of conflict had few acceptable options. Military personnel guarding embassies often found themselves restricted to carrying unloaded weapons. National guards or policing forces charged with quelling riots were able to use only Batons or similar club-like weapons, or bayonet or saber charges, or fire live ammunition at crowds. In the late 1980s and early 1990s, the Non-lethality Policy Review Group at U.S. Global Strategy Council in Washington and other independent think tanks around the world called for a concerted effort to develop weapons that were more life-conserving, environmentally friendly, and fiscally responsible than weapons available at that time. The futurists Alvin Toffler and Heidi Toffler reported comprehensively on this phase of the history of non-lethal weapons in their 1993 book, War and Anti-War. The U.S. Congress and other governments agreed and began an organized development of non-lethal weapons to provide a range of options between talking and shooting.

One category of less than lethal weapons under development is sonic, acoustic psycho-acoustic weapons intended to inflict serious discomfort, pain or even light injury to persons within a target area of the weapon. These weapons are intended to generate and direct sound waves at the target area with an intensity and frequency composition known to achieve a desired discomfort/pain/damage level in persons within the area. To date, effective solutions for controllably generating and directing sufficient amounts of acoustic energy across a sufficient range of distances and spreads do not exist. There is a need for improved methods, devices apparatus, assemblies and systems for generating and directing sound pressure waves.

SUMMARY OF INVENTION

The present invention includes methods, devices, apparatus, assemblies and systems for generating and directing acoustic energy (e.g. sound). According to some embodiments, there may be provided a cyclical acoustic apparatus or generator comprising a cyclical combustions chamber adapted to cyclically generate acoustic energy, an acoustic energy collection and guiding assembly adapted to channel sounds energy generated by said cyclical combustion chamber to an aiming and release apparatus, which aiming and release apparatus directs the acoustic energy towards a target zone.

The generator may include a targeting system adapted to adjust one or more parameters of the either said combustion chamber, said guiding assembly and/or said aiming and release apparatus based on a distance or position of a target zone relative to said generator. The targeting system may adjust the one or more parameters such that an intended acoustic energy level is delivered to the target zone.

The present invention includes methods, devices, apparatus, assemblies and systems for generating and directing acoustic energy (e.g. sound). According to some embodiments, there may be provided a cyclical combustion apparatus or device, which combustion apparatus or device may include a combustion chamber adapted to facilitate cyclical combustion of a material which may be in either solid, liquid or vapor state (e.g. an air petroleum fuel mixture). Acoustic (sound) energy generated by the combustion chamber may be collected by a portion of an acoustic energy collection/guiding assembly. The sound energy may be directed by the guiding assembly towards a target via an acoustic aiming and release apparatus which may be either integral or otherwise functionally associated with the acoustic collection/guiding assembly. According to some embodiments, the combustion apparatus may be integral with an internal combustion engine, and the acoustic collection/guiding assembly and the acoustic aiming & release apparatus may be functionally associated with an exhaust outlet of the internal combustion engine.

According to some embodiments, the cyclical combustion apparatus may be a discrete or standalone apparatus whose sole purpose is to generate cyclical sound waves. While according to alternative embodiments, the combustion apparatus may be integral with or otherwise associated with an internal combustion engine driving or propelling a vehicular platform (e.g. Car, Jeep, Tank, etc.). According to some embodiments where the cyclical combustion apparatus is a standalone apparatus (e.g. not an internal combustions engine driving a vehicle), the apparatus may be placed on a variable position support structure (e.g. Turret). According to some embodiments where the cyclical combustion apparatus is part of an internal combustion engine driving a vehicular platform, the combustion apparatus' position relative to the platform may be fixed, and acoustic output from the combustion chamber of the apparatus may be directed in variable directions by: (1) an adjustable acoustic collection/guiding assembly, and/or (2) an adjustable acoustic aiming and release apparatus.

According to some embodiments, the cyclical combustion apparatus may include one or more combustion chambers, each with one or more inlets for combustible material to enter the chamber. Each combustion chamber may also include one or more outlets through which combustion exhaust may exit. There may be valves on the combustion chamber inlets and outlets, which valves may be synchronized with timing of a combustion trigger (e.g. spark source) so as to achieve and maintain an intended cyclical combustion rate. Additionally, the combustion chamber may include a compression mechanism for compressing combustible material prior to igniting it. The combustion chamber and/or some of its associated elements (e.g. outlets) may be configured so as to have an acoustic-shaping geometry which directs a significant portion of the acoustic energy generated by combustion within the chamber towards an interface with an acoustic collection/guiding assembly, which assembly may carry the acoustic energy towards an acoustic aiming and release apparatus for projecting the acoustic energy towards a target area.

According to some embodiments, the cyclical combustion apparatus may be in the form of an internal combustion engine whose exhaust outlet(s) may be substantially aligned with one or more acoustic collection/guide assemblies in order to optimize collection and delivery of acoustic energy generated within the cylinders of the engine to the aiming and release apparatus. According to one embodiment, the collection and targeting/release assemblies may be integral or otherwise associated with each other, and may form a substantially straight conduit or guide for the acoustic energy.

During production of embodiments where the cyclical combustion chamber is part of an internal combustion engine, the engine and its exhaust path may be optimized for sound generation and/or shaping. The Exhaust outlet may be modified to be larger than conventional outlets for comparable internal combustion engines. According to further embodiments, an acoustic energy release apparatus of the system may include a water or land interface (e.g. impedance matching portion, such as a membrane or series of impedance matching layers) for projecting cyclical acoustic output from the combustion chamber into either a body of land or a body of water.

According to some embodiments, the acoustic collection and guiding assembly may include: (1) a combustion chamber coupler/collector; (2) a sound-wave or acoustic guide/conduit; (3) an acoustic aiming and release apparatus—which release apparatus may include impedance matching materials; and (4) one or more output energy regulators. The combustion chamber coupler/collector may receive acoustic energy generated in a functionally associated combustion chamber. The guide or conduit may carry acoustic energy collected at or near the combustion chamber to the acoustic aiming and release apparatus, which apparatus may be functionally associated with an interface to a variety of mediums including air, water and soil.

According to further embodiments, the aiming and release apparatus may be adapted to concurrently direct acoustic energy to multiple directions. According to some embodiments, the apparatus may include a circular, dome or parabolic shaped structure. According to such embodiments, acoustic energy may be targeted onto and reflected off of a circular, parabolic or dome shaped reflector.

An acoustic Frequency/Energy transfer function of the collection to release assemblies (collection and guiding assembly and aiming and release apparatus) may be selected, regulated or adjusted via parameter selection such as conduit length, conduit diameter, conduit material composition, conduit material thickness, and curvature of various portions of the assembly. Additionally, structures such as spoilers, openings, resonating cavities, dimples, sound generation/modification structures (e.g. fins etc.) may be added. Some parameters may be selected and fixed during manufacture and other may be adjusted during operation by a control system connected to one or more actuators on either the collection and guiding assembly or on the aiming and release apparatus. The release apparatus may also include a nozzle designed to act as sounds shaper.

According to further embodiments, there may be provided an acoustic energy targeting and delivery control system adapted to: (1) estimate direction and distance to a target zone; (2) determine combustion apparatus and delivery assembly parameters (e.g. combustion rate, acoustic collector/guide/release apparatus configuration, Internal combustion engine RPM level, valve position and timing, etc.) for delivering an intended energy levels/density to the specific target zone; (3) generate control signals intended to achieve/implement (e.g. through actuators) the determined system parameters. The acoustic energy targeting and delivery control system may include environmental sensors/detectors and may compensate for factors such as: (a) air temperature, (b) humidity, (c) wind direction, (d) air density, and (e) surrounding reflecting objects when determining system parameters intended to achieve an intended acoustic energy level at the intended target zone. The acoustic energy targeting and delivery control system may also determine direction of a moving target zone and may adjust intended energy delivery levels accordingly.

The acoustic energy targeting and delivery control system may include a ranging (e.g. laser ranging) device or subsystem and a targeting computer programmed to determine acoustic generation and delivery parameters based on an output of the ranging device and based on an intended delivered acoustic energy level.

The acoustic energy targeting and delivery control system may include an imaging device (e.g. camera), a display, and a user interface (e.g. touchscreen) for allowing a user to select targets or target zones. According to some embodiments, a user's selection of a target or zone on a screen may cause the ranging device to range distance to the selected target and to provide system parameters for delivering an intended amount of acoustic energy to the target area.

BRIEF DESCRIPTION OF THE FIGURES

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
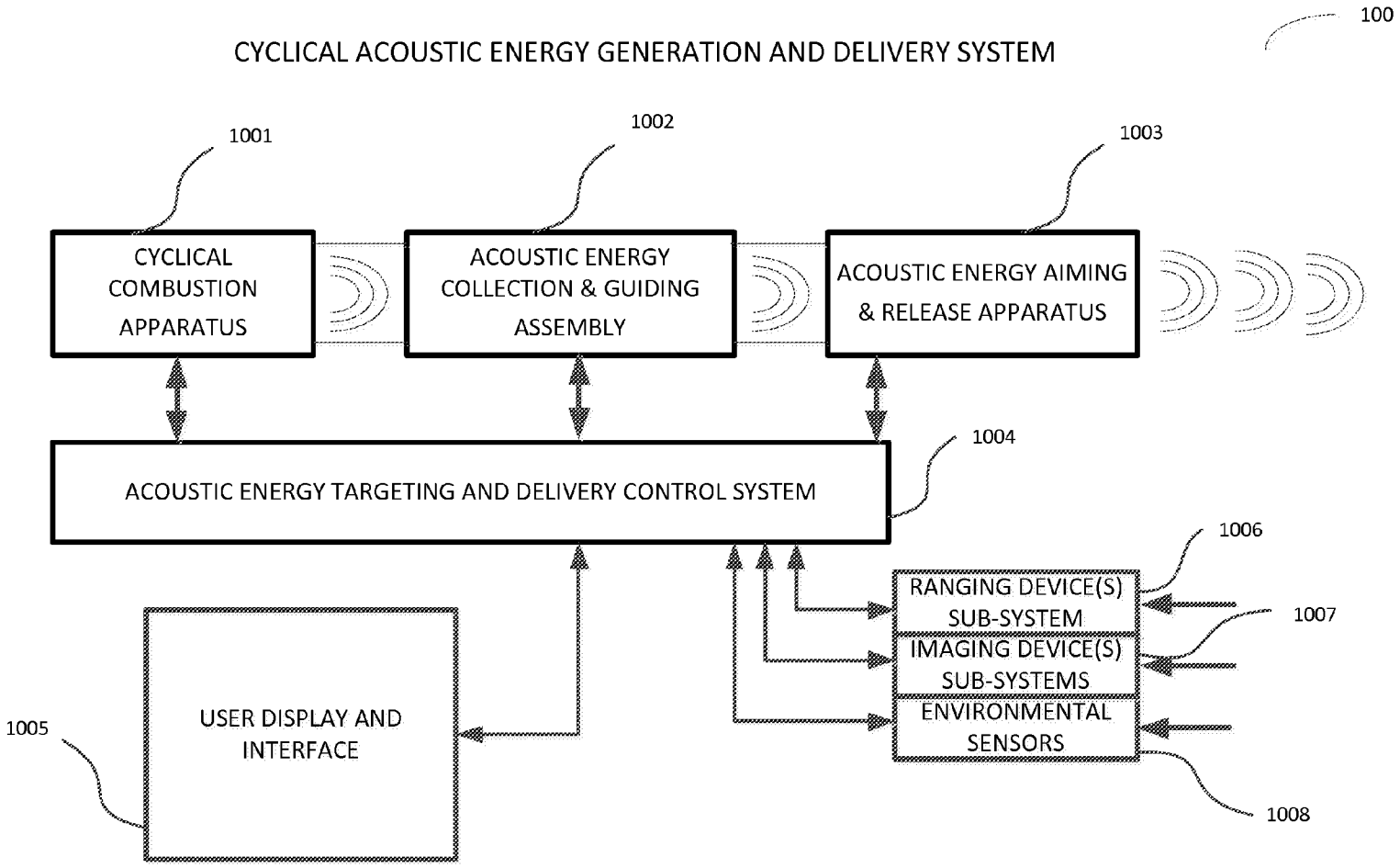
FIG. 1 is a functional block diagram including functional blocks of a cyclical acoustic energy generation and delivery system according to embodiments including: (1) a cyclical combustion chamber, (2) an acoustic energy collection and guiding assembly, (3) an aiming and release apparatus, and (4) a targeting and delivery control system according to embodiments.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

Unless specifically stated otherwise, as apparent from the following discussions, it is appreciated that throughout the specification discussions utilizing terms such as "processing", "computing", "calculating", "determining", or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

Embodiments of the present invention may include apparatuses for performing the operations herein. This apparatus may be specially constructed for the desired purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs) electrically programmable read-only memories (EPROMs), electrically erasable and programmable read only memories (EEPROMs), magnetic or optical cards, or any other type of media suitable for storing electronic instructions, and capable of being coupled to a computer system bus.

According to further embodiments, there may be provided a regulated energy emitting apparatus, wherein an amplitude, energy level, power, frequency composition and/or spread of the emitted energy may be regulated. Regulation of the controllable energy emitting apparatus may be performed by functionally associated targeting system, which targeting system may select an emitted amplitude, energy level, power, frequency composition and/or spread to achieve an intended delivered energy composition or profile (amplitude, energy level, power, frequency composition and/or spread) within a target zone. The targeting system may be functionally associated with a distance ranging subsystem (optical, laser, radar, sonic or alike) to determine a distance between the emitting apparatus and a target zone. The targeting system may also include one or more transmission medium sensors, including air temperature sensors, air humidity sensors, rain density sensor, snow density sensors, air velocity sensors, water temperature sensors, water velocity sensors and/or any other sensors which may be relevant for estimating emitted energy attenuation and/or dispersion between the emitting apparatus and the target zone. The one or more sensors may be sensors of any relevant parameter of any transmission medium (e.g. air, water, soil, rain, snow, etc.) which may reside between the emitter apparatus and the target zone.

A processing unit of the targeting system may calculate a required emitted energy amplitude, level, power, frequency composition and/or spread at the emitting apparatus in order to achieve the intended delivered energy amplitude, level, power, frequency composition and/or spread at the target zone. The processing unit of the targeting system may calculate and/or estimate a required emitted energy amplitude, level, power, frequency composition and/or spread at the emitting apparatus to achieve a delivered energy composition at the target zone distance determined by the ranging subsystem, while factoring in attenuation, dispersion, reflection and/or spread of experienced by the emitted energy within the transmission medium conditions, as sensed by the one or more sensors, at the target zone distance. The processing unit may estimate a transfer function for the emitted energy in the air between the emitter and the target zone, and by plugging into the transfer function an intended delivered energy composition, the processing unit may estimate an emitted energy amplitude, level, power, frequency composition and/or spread required to achieve the intended delivered energy composition.

According to further embodiments, the targeting system may include or be otherwise functionally associated with an energy emitting apparatus controller. The controller may electrically or electromechanically adjust one or more functional parameters of the energy emitting apparatus in order to cause the energy emitting apparatus to output the emitted energy amplitude, frequency composition and/or spread required to achieve the intended delivered energy composition, as estimated by the processing unit. The processing unit and/or the controller may be programmed with one or more conversion functions of the emitter apparatus, which one or more conversion functions may define relationships with one or more functional parameters and one or more emitted energy characteristics such as amplitude, level, power, frequency composition and/or spread.

According to some embodiments, a single targeting system may be functionally associated with two or more synchronized energy emitting apparatuses. The targeting system may factor constructive/combined energy delivery parameters at an overlapping delivery region to which both emitting apparatuses are concurrently delivering energy. According to some embodiments of the present invention, the targeting system may calculate required emitted energy compositing parameters for each of two or more emitting apparatuses such that: (1) energy emitted by each of the apparatuses is negligibly harmful or subcritical, while (2) a constructive/combined energy composition of the two or more energy emitting apparatuses within an overlapping delivery region may be harmful or critical. The targeting system may cause one or more of the two or more emitting apparatuses to change direction so as to define and redefine the overlapping delivery region, wherein the overlapping delivery region may be an intended target zone. The intended target zone may be embedded within a crowd. According to further embodiments, the targeting system may activate and/or point additional energy emitting apparatuses towards an overlapping delivery region, such as an intended target zone. According to further embodiments, the targeting system may factor the use of earplugs or other protective geek when estimating an emitted energy composition required to deliver an intended energy composition to a target zone.

The energy emitting apparatus may be an acoustic energy emitter, a radio frequency emitter, a photonic energy emitter and/or any other energy emitter known today or to be devised in the future.

The processes and displays presented herein are not inherently related to any particular computer or other apparatus. Various general purpose systems may be used with programs in accordance with the teachings herein, or it may prove convenient to construct a more specialized apparatus to perform the desired method. The desired structure for a variety of these systems will appear from the description below. In addition, embodiments of the present invention are not described with reference to any particular programming language. It will be appreciated that a variety of programming languages may be used to implement the teachings of the inventions as described herein.

Turning now to FIG. 1, there is shown a functional block diagram including functional blocks of a cyclical acoustic energy generation and delivery system 100 according to embodiments including: (1) a cyclical combustion chamber 1001, (2) an acoustic energy collection and guiding assembly 1002, (3) an aiming and release apparatus 1003, and (4) a targeting and delivery control system 1004. Additionally, there is shown a control system which may regulate or adjust operational parameters or configurations of one or more constituent components of the cyclical acoustic energy generation and delivery system. The acoustic energy targeting and delivery control system may be associated with a number of sensors and may be adapted to: (1) estimate direction and distance to a target zone; (2) determine combustion apparatus and delivery assembly parameters (e.g. combustion rate, acoustic collector/guide/release apparatus configuration, Internal combustion engine RPM level, valve position and timing, etc.) for delivering an intended energy levels/density to the specific target zone; (3) generate control signals intended to achieve/implement (e.g. through actuators) the determined system parameters. The acoustic energy targeting and delivery control system may include environmental sensors/detectors 1008 and may compensate for factors such as: (a) air temperature, (b) humidity, (c) wind direction, (d) air density, and (e) surrounding reflecting objects when determining system parameters intended to achieve an intended acoustic energy level at the intended target zone.

The acoustic energy targeting and delivery control system may include a ranging (e.g. laser ranging) device or subsystem 1006 and a targeting computer programmed to determine acoustic generation and delivery parameters based on an output of the ranging device and based on an intended delivered acoustic energy level according to some embodiments.

The acoustic energy targeting and delivery control system may include an imaging device 1007 (e.g. camera), a display, and a user interface 1005 (e.g. touchscreen) for allowing a user to select targets or target zones. According to some embodiments, a user's selection of a target or zone on a screen may cause the ranging device to range distance to the selected target and to provide system parameters for delivering an intended amount of acoustic energy to the target area.

According to some embodiments the acoustic energy targeting and delivery control system may also determine direction of a moving target zone and may adjust intended energy delivery levels accordingly.

Figure 2A:
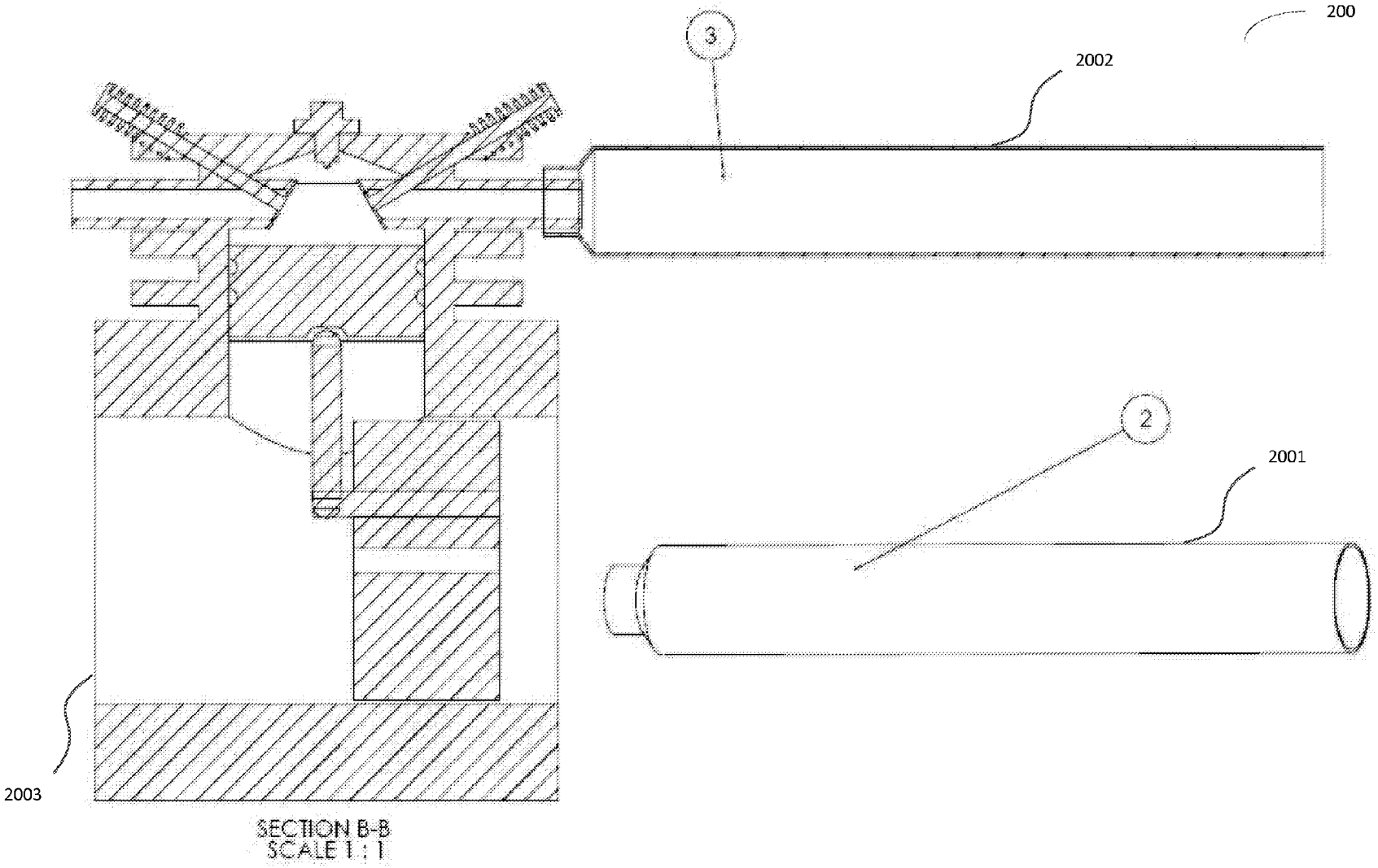
FIG. 2A is a cross sectional view of an embodiment of the present invention where the cyclical combustion chamber is part of an internal combustion engine and the collection/guiding assembly is in the form of tube or conduit connected to an exhaust outlet of the internal combustion engine.

Turning now to FIG. 2A, there is shown a cross sectional view of an embodiment of the present invention where the cyclical combustion apparatus 200 is part of an internal combustion engine and the collection/guiding assembly 2002 is in the form of a tube or conduit connected to an exhaust outlet of the internal combustion engine 2003. The cyclical combustion apparatus or device may include a combustion chamber adapted to facilitate cyclical combustion of a material which may be in either solid, liquid or vapor state (e.g. an air petroleum fuel mixture). Acoustic (sound) energy generated by the combustion chamber may be collected by a portion of an acoustic energy collection/guiding assembly 2002. The sound energy may be directed by the guiding assembly towards a target via an acoustic aiming and release apparatus which may be either integral or otherwise functionally associated with the acoustic collection/guiding assembly. According to some embodiments, the combustion apparatus may be integral with an internal combustion engine, and the acoustic collection/guiding assembly and the acoustic aiming & release apparatus may be functionally associated with an exhaust outlet of the internal combustion engine, as shown in FIG. 2A.

Figure 2B:
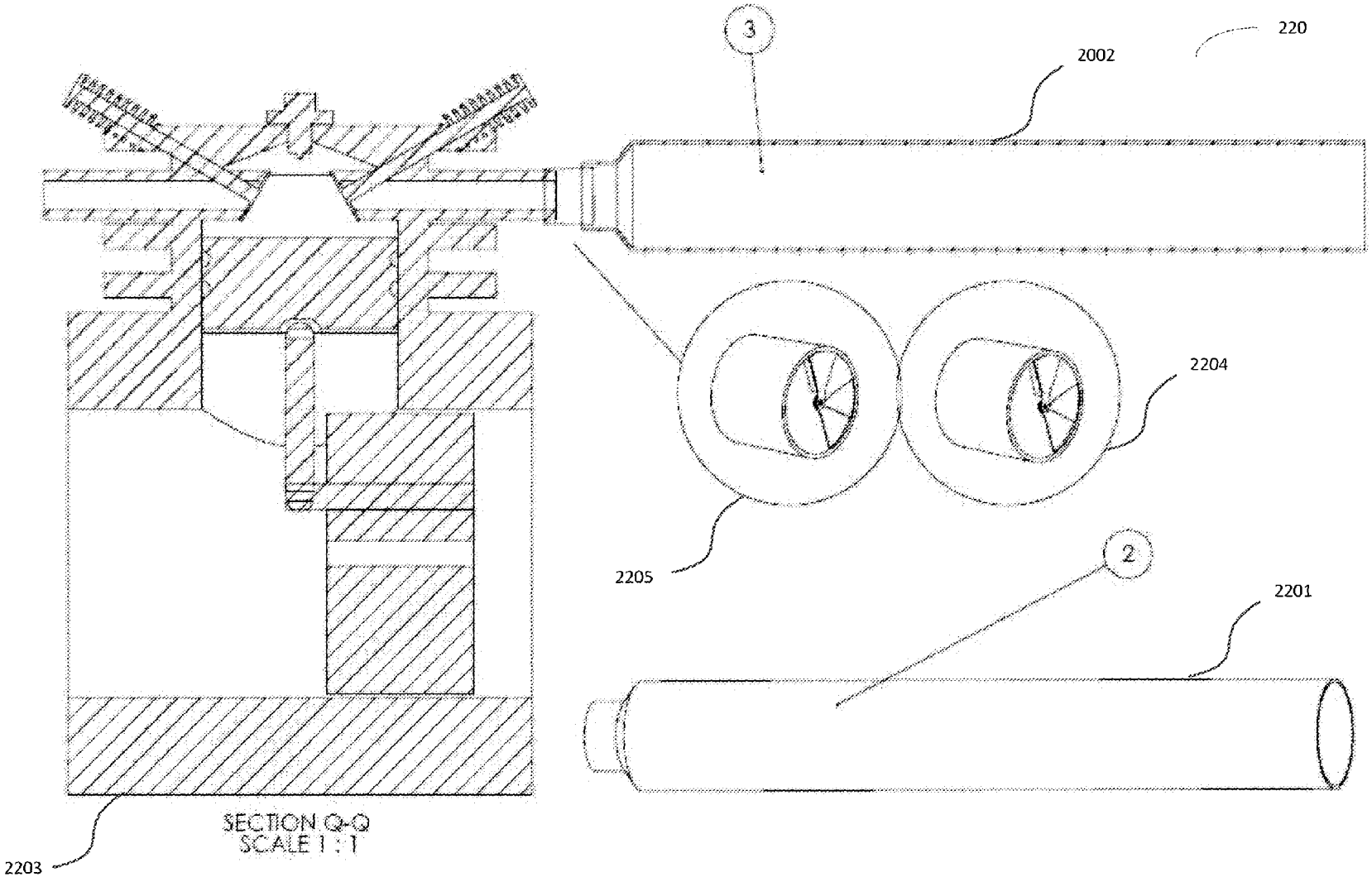
FIG. 2B is a cross sectional view of an embodiment of the present invention where the cyclical combustion chamber is part of an internal combustion engine and the collection/guiding assembly is in the form of tube or conduit connected to an exhaust outlet of the internal combustion engine and includes an (optionally: actuator) adjustable outlet valve.

Turning now to FIG. 2B, there shown a cross sectional view of an embodiment of the present invention where the cyclical combustion chamber is part of an internal combustion engine 220, as in FIG. 2A, and the collection/guiding assembly 2202 is in the form of tube or conduit connected to an exhaust outlet of the internal combustion engine 2203 and includes an (optionally: actuator) adjustable outlet valve 2204 and 2205. The valve may be regulated by a control system such as the one shown in FIG. 1.

Figure 3:
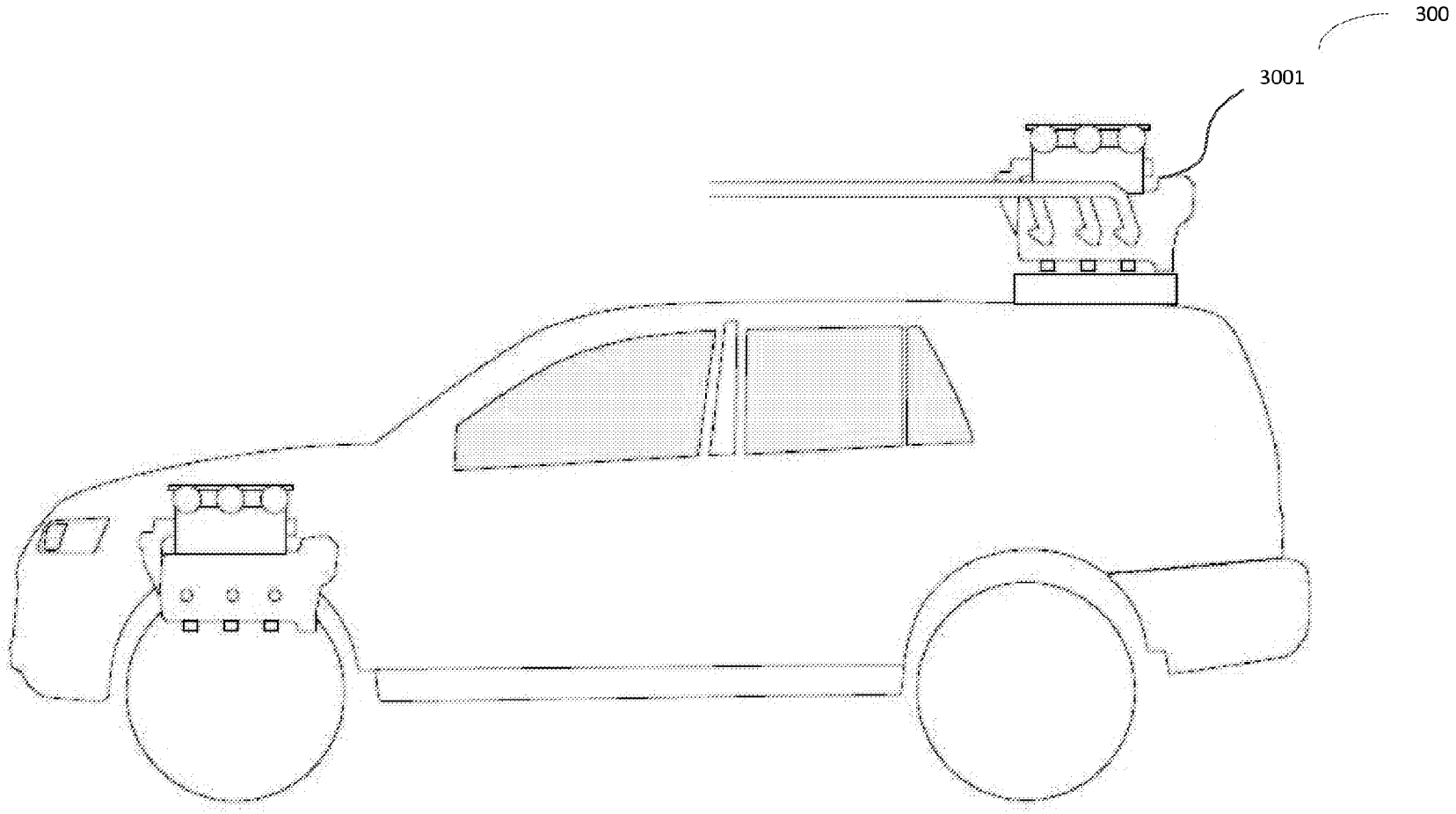
FIG. 3 is side view of a vehicular platform according to embodiments where the cyclical combustion apparatus is mounted on a turret on the roof of the platform.
Figure 4:
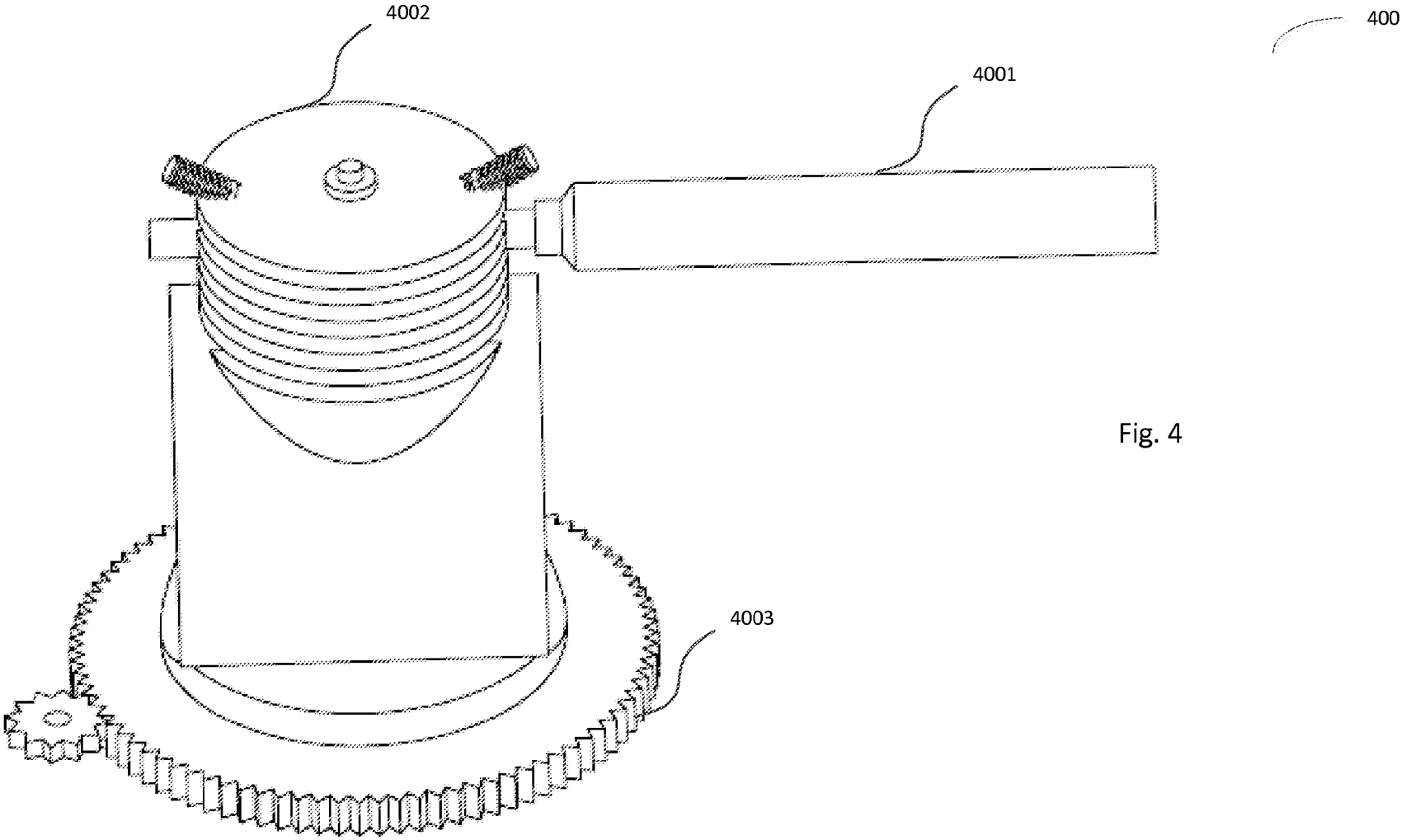
FIG. 4 is a prospective view of an exemplary rotating turret mechanism as shown in FIG. 3 according to some embodiments.

Turning now to FIG. 3, there is shown a side view of a vehicular platform 300 according to some embodiments where the cyclical combustion apparatus 3001 is mounted on a turret on the roof of the platform 3001. Turning now to FIG. 4, there is shown a prospective view of a cyclical combustion apparatus 400 with the collection/guiding assembly 4001 connected to an exhaust outlet of the internal combustion engine 4002 with an exemplary rotating turret mechanism 4003 as shown in FIG. 3 according to some embodiments.

Figure 5A:
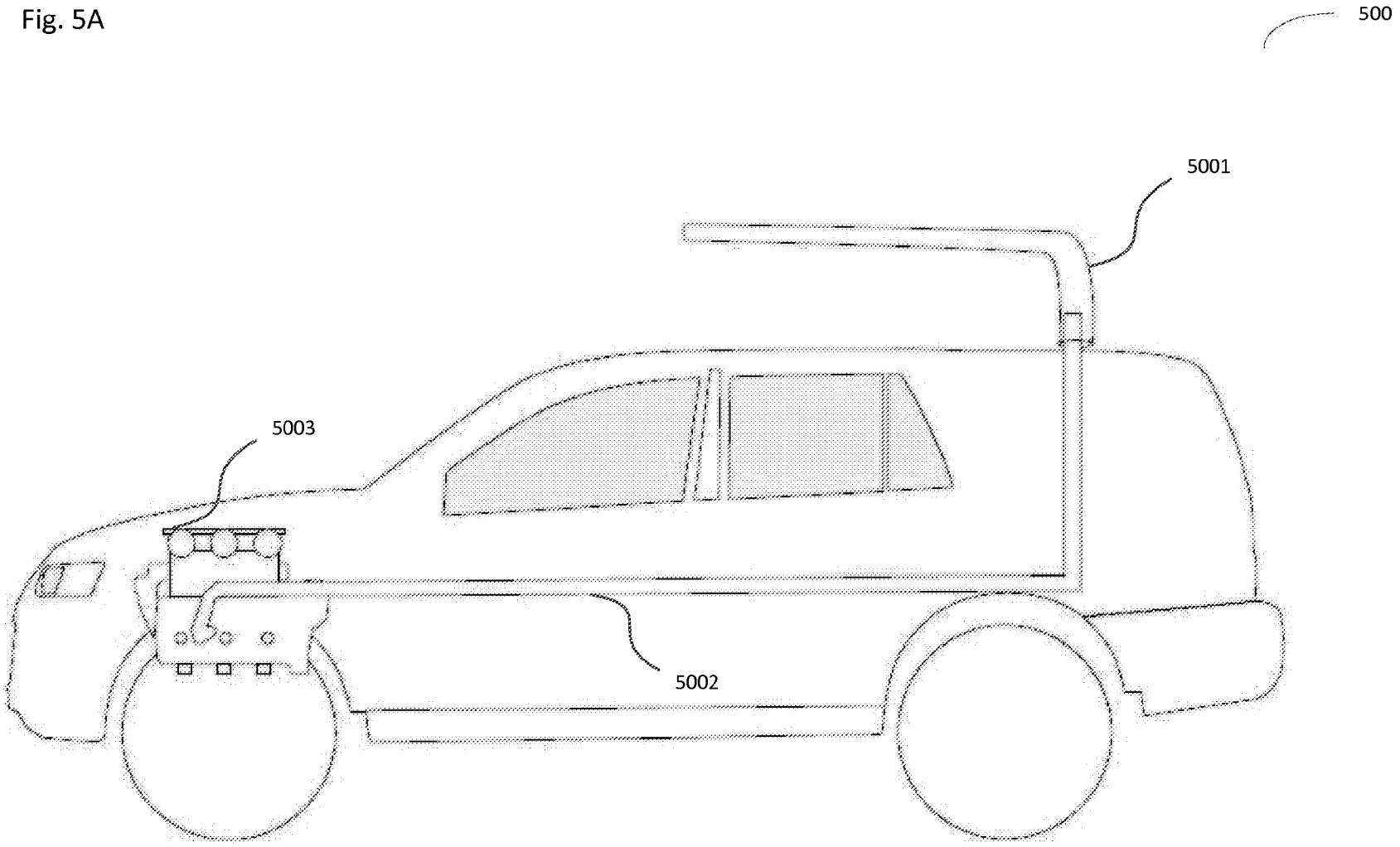
FIG. 5A is a side view of a vehicular platform according to embodiments where the cyclical combustion apparatus is part of the engine of the platform.
Figure 5B:
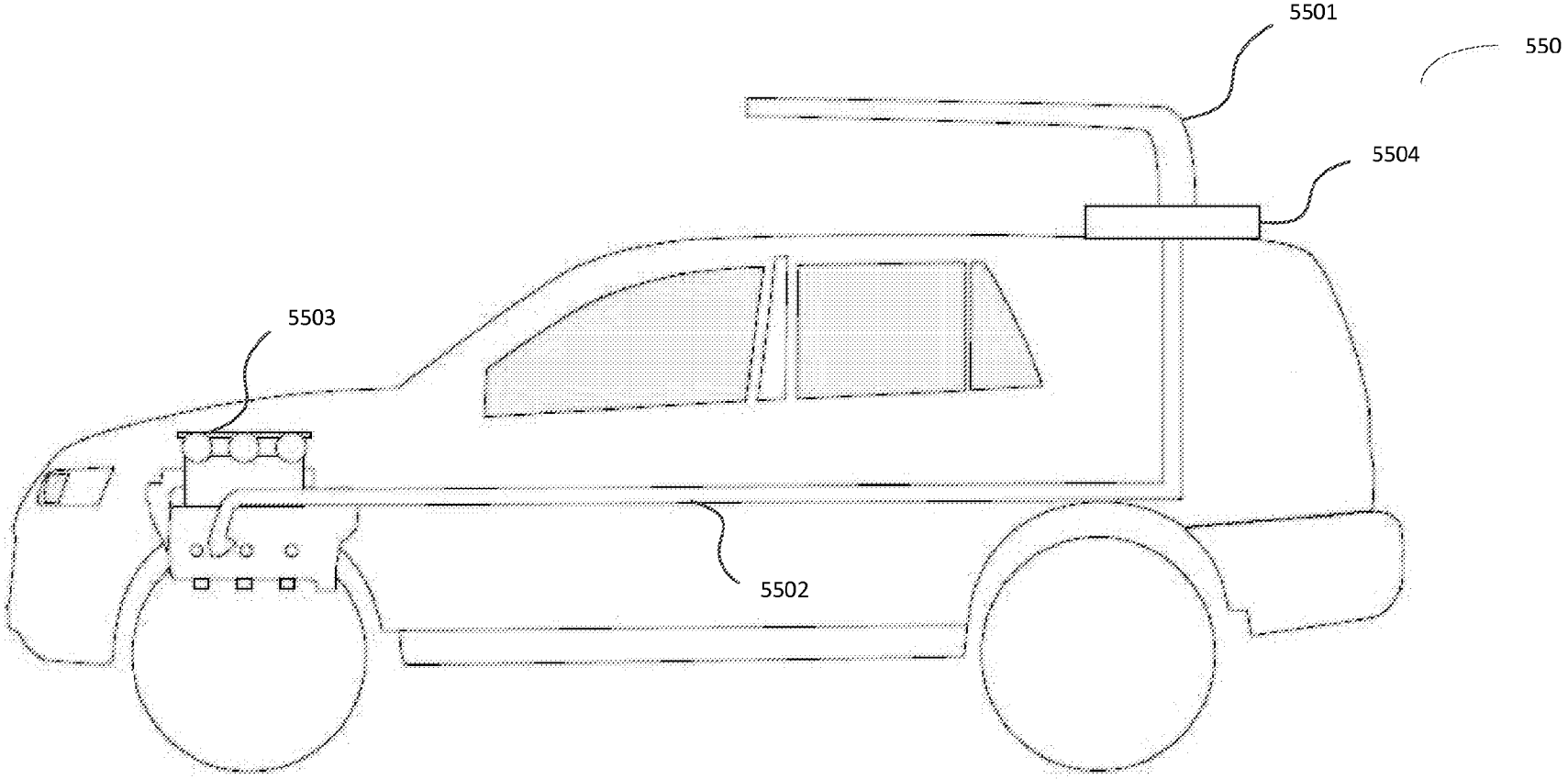
FIG. 5B is a side view of a vehicular platform according to embodiments where the cyclical combustion apparatus is part of the engine of the platform and the acoustic aiming/release apparatus connected to the collection/guiding assembly through a rotating mechanism.

Turning now to FIG. 5A, there is shown a side view of a vehicular platform 500 according to some embodiments where the cyclical combustion apparatus is part of the engine of the platform 5003. Acoustic energy is carried from the engine of the car to roof via the collection and guiding assembly 5002, where the energy is transferred to the aiming and release apparatus 5001 which may be pivotally couples to the guiding assembly. FIG. 5B shows a side view of a vehicular platform 550 according to some embodiments where the cyclical combustion apparatus is part of the engine of the platform 5503 and the acoustic aiming/release apparatus 5501 connected to the collection/guiding assembly 5502 through a rotating mechanism 5504 similar to a turret (4003).

Figure 6:
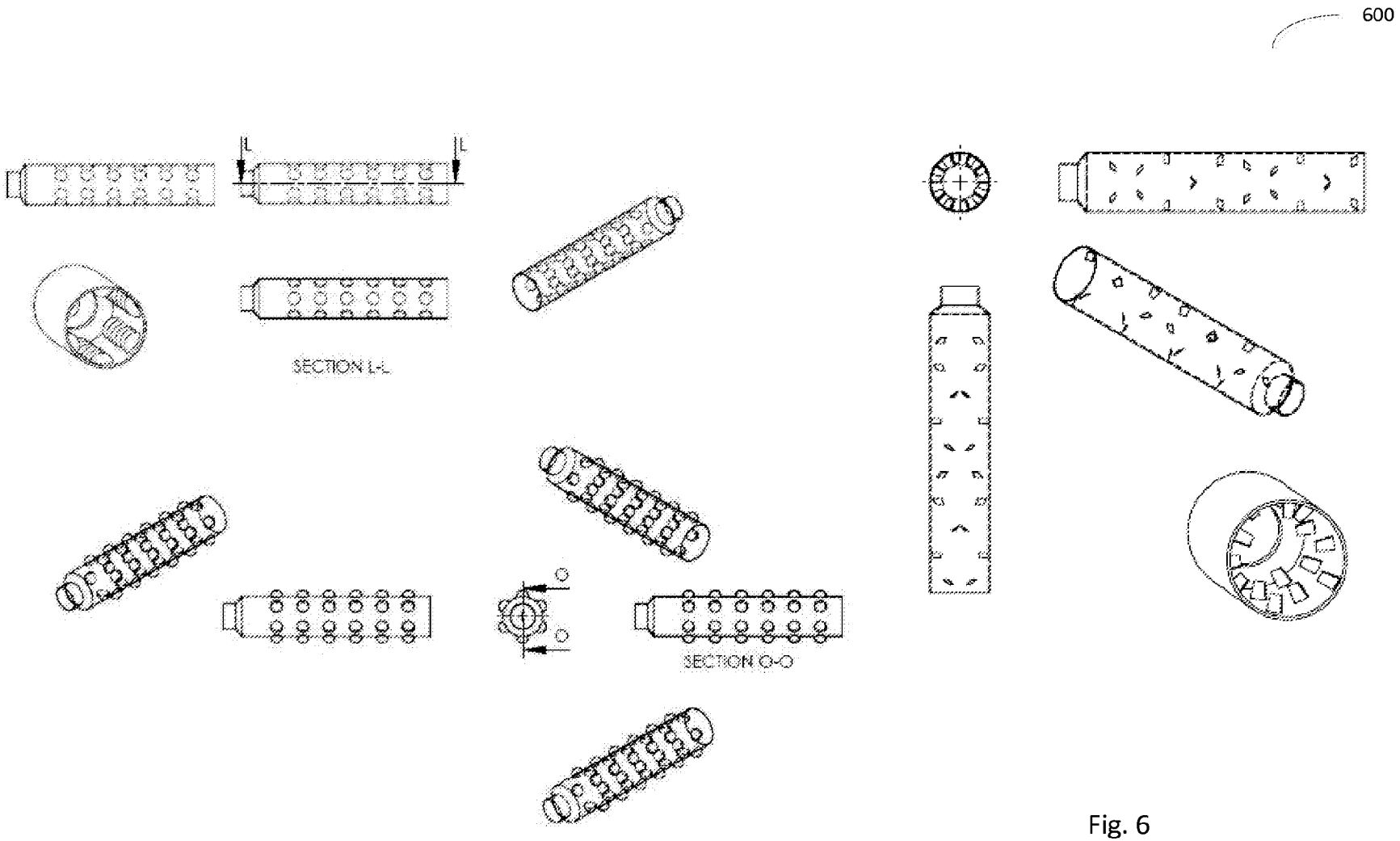
FIG. 6 shows a variety of conduits which may be used as either part of collection/guiding assemblies or release apparatus according to embodiments.

Turning now to FIG. 6, there are shown a variety of conduits 600 which may be used as either part of collection/guiding assemblies or release apparatus according to some embodiments. As shown in FIG. 6, the acoustic Frequency/Energy transfer function of the collection to release assemblies (collection and guiding assembly and aiming and release apparatus) may be selected, regulated or adjusted via parameter selection such as conduit length, conduit diameter, conduit material composition, conduit material thickness, and curvature of various portions of the assembly. Additionally, structures such as spoilers, openings, resonating cavities, dimples, sound generation/modification structures (e.g. fins etc.) may be added. Some parameters may be selected and fixed during manufacture and other may be adjusted during operation by a control system connected to one or more actuators on either the collection and guiding assembly or on the aiming and release apparatus. The release apparatus may also include a nozzle designed to act as sounds shaper.

Figure 7A:
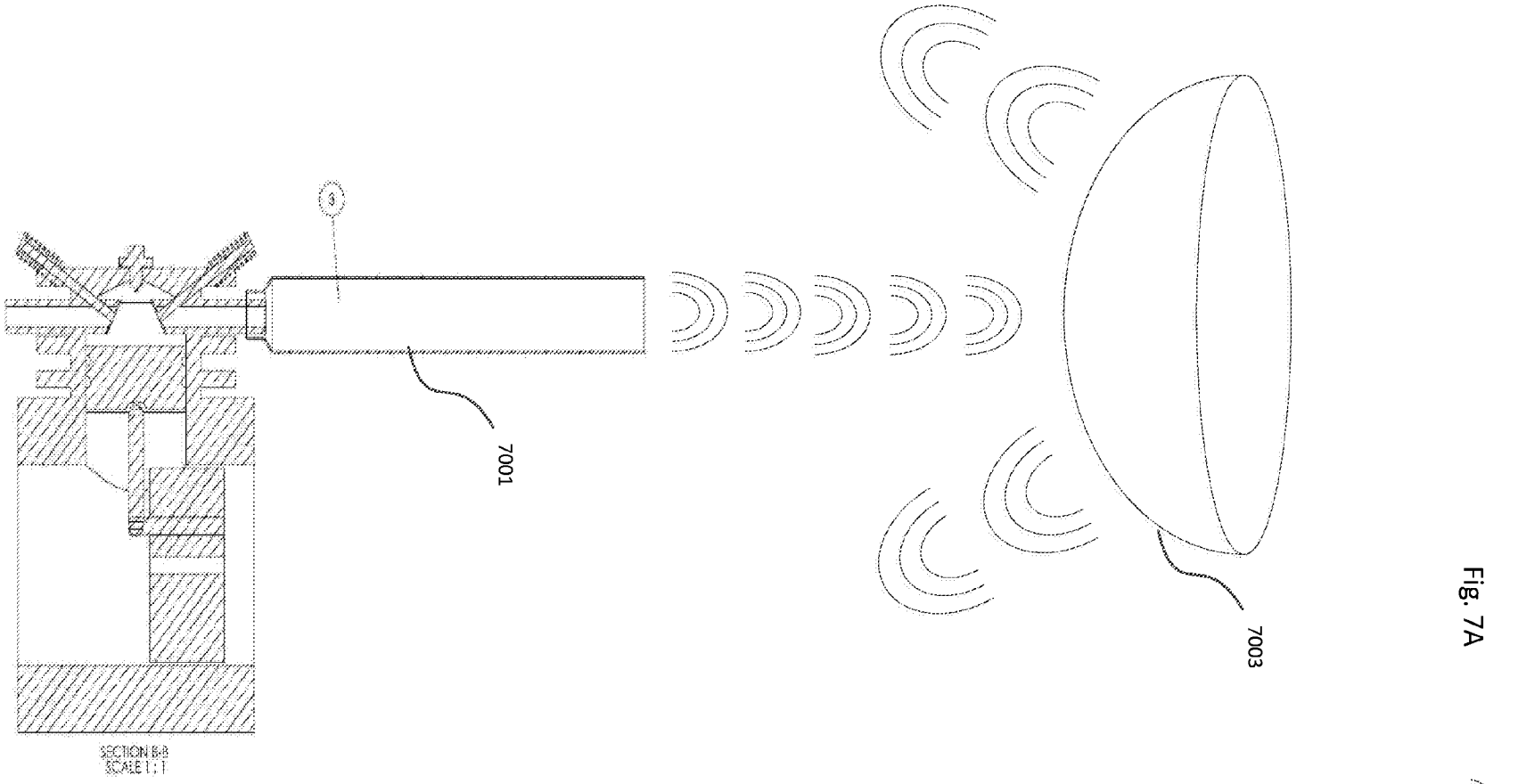
FIGS. 7A & 7B are a diagram of embodiments of the present invention where part of release apparatus includes reflectors to disperse the acoustic energy across a range of directions.
Figure 7B:
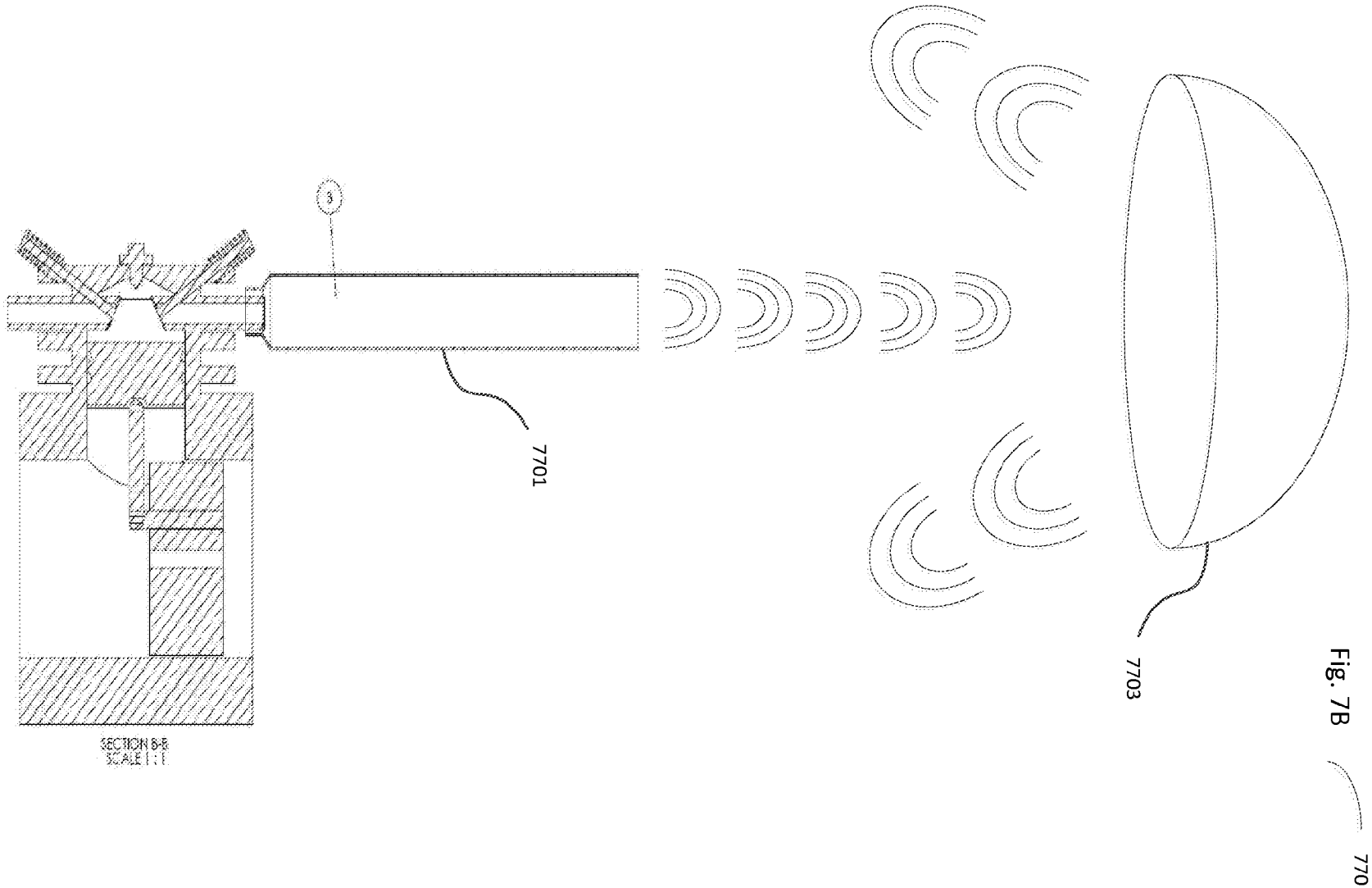

Turning now to FIGS. 7A & 7B, there are shown embodiments 700 and 770 where the aiming and release apparatus 7001 and 7701 may include reflectors 7003 and 7703 in order to disperse acoustic energy across a range of directions.

While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

The invention claimed is:

1. An acoustic generator comprising:

A cyclical combustions chamber of an internal combustion engine adapted to cyclically generate acoustic energy;

an acoustic energy collection and guiding assembly coupled to an exhaust outlet of said internal combustion engine and adapted to direct collected acoustic energy towards an acoustic energy aiming and release apparatus adjustably coupled to said collection and guiding assembly such that said acoustic energy aiming and release apparatus and the collected energy is steerable towards a target zone without moving said internal combustion engine.

2. The generator according to claim 1, further comprising a targeting system adapted to adjust one or more parameters of either said combustion chamber, said guiding assembly and/or said aiming and release apparatus based on a distance or position of a target zone relative to said generator.

3. The generator according to claim 2, wherein said targeting system adjusts the one or more parameters such that an intended acoustic energy level is delivered to the target zone.

4. The generator according to claim 3, wherein one of the parameters adjusted by said targeting system is an RPM level of said internal combustion engine.

5. The generator according to claim 3, wherein one of the parameters adjusted by said targeting system is a valve position within said internal combustion engine.

6. The generator according to claim 1 wherein said cyclical combustion chamber is shaped to direct combustion generated acoustic energy towards an interface with an acoustic energy collection and guiding assembly.

7. The generator according to claim 1, wherein said release apparatus includes one or more actuators adapted to adjust an acoustic transfer function of said apparatus.

8. The generator according to claim 2, wherein said guiding assembly includes one or more actuators adapted to adjust an acoustic transfer function of said assembly.

9. The generator according to claim 1, wherein said aiming and release apparatus is adapted to concurrently target multiple directions.

10. The generator according to claim 8, wherein said release apparatus is at least partially circular, parabolic or dome shaped.

11. The generator according to claim 1, further comprising a targeting system for regulating said internal combustion engine to achieve an emitted amplitude, energy level, power, frequency composition and/or energy spread at a target region.

12. The generator according to claim 11, wherein the targeting system is associated with a distance ranging subsystem to determine a distance between the emitting apparatus and a target zone.

13. The generator according to claim 12, wherein the targeting system includes one or more transmission medium sensors.

14. The generator according to claim 13, wherein one or more transmission medium sensors is one of: an air temperature sensors, air humidity sensor, rain density sensor, snow density sensor, air velocity sensors, water temperature sensor, water velocity sensor or any other sensors, or a combination thereof.

* * * * *